United States Patent [19]

Trummer et al.

[11] Patent Number: 4,819,780

[45] Date of Patent: Apr. 11, 1989

[54] DEVICE FOR VERIFYING COINS

[75] Inventors: Bernhard Trummer, Bern; Stefan Luder, Burgdorf, both of Switzerland

[73] Assignee: Autelca AG., Gümligen, Switzerland

[21] Appl. No.: 43,346

[22] PCT Filed: Jul. 25, 1986

[86] PCT No.: PCT/CH86/00105

§ 371 Date: Mar. 25, 1987

§ 102(e) Date: Mar. 25, 1987

[87] PCT Pub. No.: WO87/00661

PCT Pub. Date: Jan. 29, 1987

[30] Foreign Application Priority Data

Jul. 26, 1985 [CH] Switzerland ..... 3254/85

[51] Int. Cl.[4] ..... G07D 5/08

[52] U.S. Cl. ..... 194/317; 194/330

[58] Field of Search ..... 194/317, 318, 319, 328, 194/330; 324/233, 239, 229

[56] References Cited

U.S. PATENT DOCUMENTS 3,918,565 11/1975 Fougere et al. ..... 194/317
3,921,003 11/1975 Greene ..... 250/557
4,124,111 11/1978 Hayashi ..... 194/319 X
4,601,380 7/1986 Dean et al. ..... 194/318

FOREIGN PATENT DOCUMENTS 0060392 9/1982 European Pat. Off. .
0503338 3/1971 Switzerland .

*Primary Examiner*—F. J. Bartuska
*Attorney, Agent, or Firm*—Brady, O'Boyle & Gates

[57] ABSTRACT

In order to check whether the coin (2) has the impress design of an acceptable coin, the coin surface is scanned along a track (10) by an inductive probe (5), thus producing a signal which corresponds to the depth of the impression along the track (10). The relative movement of the probe (5), which is needed for scanning, in relation to the coin (2) is obtained as the coin (2) rolls past the probe (5). A memory stores, as comparison signals, signals obtained at mutually displaced tracks (10, 11) of the obverse side and reverse side of each acceptable coin. These signals are obtained as each coin to be verified rolls past the probe (5) from various starting positions. The verification signal received from the coin to be checked is compared with each of the stored comparison signals. If one of these comparisons results in coincidence within specific limits, then a coincidence signal is transmitted.

6 Claims, 2 Drawing Sheets

DEVICE FOR VERIFYING COINS

The invention relates to a device for verifying coins, with at least one self-induction coil excited by high frequency and serving as an inductive probe, which coil can be influenced by the coin to be checked for generating a signal depending on the type of coin.

It is known, for example, to design and arrange two such probes so that the signal of one probe depends essentially on the coin diameter and the signal of the other depends essentially on the alloy characteristics of the coin governing for the influence, in order to verify whether the coin has these two properties of an acceptable coin (FR-A-No. 2 212 589).

However, an important distinguishing feature of differing coins is the stamped pattern, i.e. the indication of a number and of the currency on one side, and the representation of a coin design, for example a coat of arms, on the other side of the coin. Coins of approximately identical dimensions and alloy differ solely by the stamped design. In conventional devices for coin verifying, the stamped pattern, however, is not taken into consideration.

Although it is conventional to check also the depth of the impress (U.S. Pat. No. 4,108,296), this does not yield information regarding the impress design. Different coins can quite definitely be stamped to the same depth.

The invention is to provide a remedy in this respect. The invention, as characterized in claim 1, solves the problem of providing a device for coin verification which yields a coincidence signal in case the impress design of the coin to be checked coincides with the impress design of one of several, specific, acceptable coins. In the dependent claims, special embodiments of this invention are set forth.

The advantages attained by the invention are to be seen essentially in that the impress design of one coin side is generally already sufficient for distinguishing the coin from coins of all other kinds, and optionally correlating the coin with a specific one of several coin types denoted to be acceptable. Since several coin types of the same currency frequently exhibit the same coin design in differing sizes, it is important that the device of this invention also distinguishes among such coins. Additional advantages of the invention and their embodiments can be seen from the following description.

The invention will be described in greater detail below with reference to drawings depicting merely one possibility for practising the invention. In the drawings.

Figure 1:
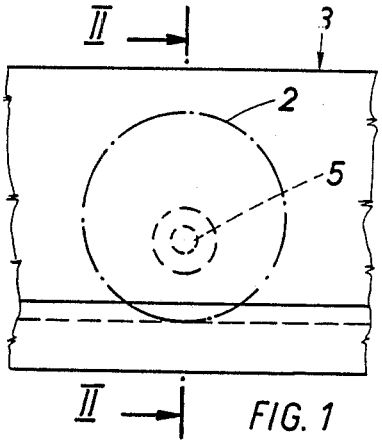
FIGS. 1 and 2 are a lateral view and a cross section of a coin guide.
Figure 2:
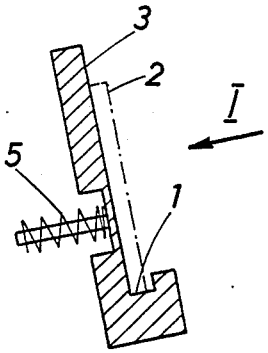

The coin guide, of which FIG. 1 shows a lateral view and FIG. 2 a cross section along line II—II in FIG. 1, comprises a roll track surface 1 for the coin 2 to be checked and a steep guide surface 3 along which latter the coin 2, rolling on the roll track surface 1, slides with its obverse side or reverse side contacting.

An inductive probe 5 is arranged behind the guide surface 3, this probe extending up to, or almost up to, the guide surface 3. The diameter of the probe 5 is substantially smaller than the diameter of the smallest acceptable coin, and the spacing of the probe 5 from the roll track surface 1 is larger than the radius and smaller than the diameter of that of the coins to be accepted which has the smallest diameter. The objective thus attained is that the probe 5 scans a track along coins of the denoted diameter range rolling past the probe which is of adequate length for the present purposes described in greater detail below.

Figure 3:
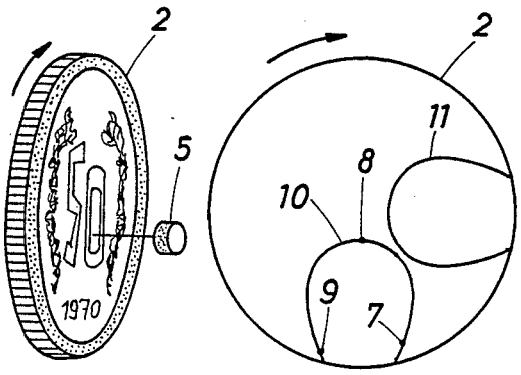
FIGS. 3 and 4 illustrate a process during which an inductive measuring probe scans a track on a coin rolling past this probe in front of the latter.
Figure 4:
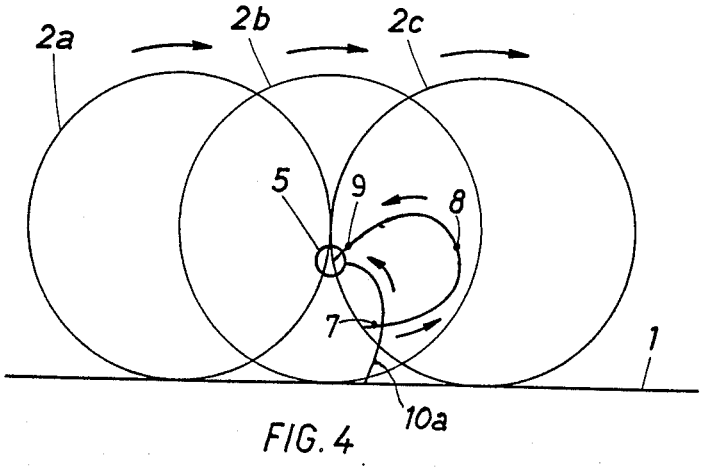

FIG. 3 shows the coin 2 with a scanning track, and FIG. 4 shows three phases of the scanning operation. In FIG. 4, the coin reaches the probe 5 in its position 2*a*, whereupon the site 7 of the coin edge passes by the probe 5. At 2*b*, the coin 2 is in a central position with respect to the probe 5, the site 8 passing by the probe 5, and in position 2*c* the coin 2 leaves the probe 5, the point 9 of the coin edge passing by the probe 5. The track scanned by the probe 5 during this process is denoted by 10. In position 2*b*, one half 10*a* of track 10 has been scanned. The course of this track is the same for all coins having identical diameter. However, the position of track 10 relatively to the design of the impress is undetermined, for it is uncertain how the sites 7, 8 and 9 lie with respect to the embossed pattern. For example, if the coin reaches the probe 5 in a position offset with respect to the illustrated position by 90 angular degrees in the clockwise direction, then the track is produced denoted by 11. It can likewise be seen that two coins of differing diameters, exhibiting the same impress design in differing sizes, are also always scanned, independently of this positional dependency, along tracks taking a different course in relation to the design.

Figure 6:
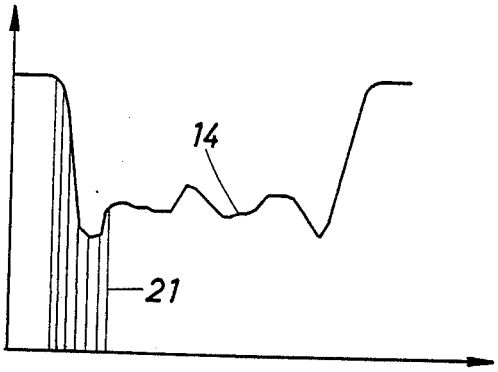
FIG. 6 is a signal diagram.

The influence exerted by the coin on the probe depends on whether, and to which extent, the surface of coin 2 is indented at the location of the impress design present in front of the probe 5. Under this influence, self-induction and damping of the probe 5 are varied. With the coin 2 rolling past the probe 5, the chronological curve of these probe characteristics constitutes information on the portion of the impress design extending along the track (for example 10). If the probe 5 is, for example, the oscillating circuit coil of an oscillator (13 in FIG. 5), then the oscillating circuit voltage drops due to the effect on the damping while the site 7 of the (unindented) coin edge of the coin 2 passes by the probe 5. Subsequently, the oscillating circuit voltage fluctuates in correspondence with the changes in impress depth along the scanned track, and finally the oscillating circuit voltage rises again when the site 9 of the coin edge goes past the probe 5. Such a course of the oscillating circuit voltage is illustrated in FIG. 6. The frequency of the oscillator oscillations changes likewise correspondingly.

Figure 5:
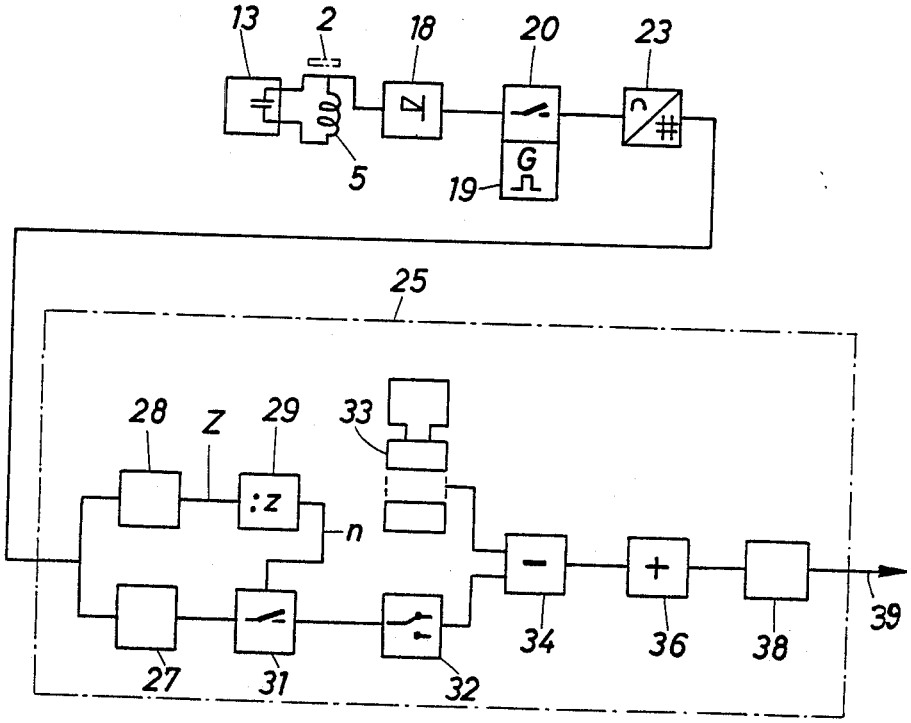
FIG. 5 shows a block circuit diagram of a device for coin verification.

In the present device, signals of this type obtained at various tracks of both sides of each acceptable kind of coin are stored in a memory (33, FIG. 5). For this purpose, respectively one acceptable coin is released from a part of the roll track surface that has a gradient (not illustrated), in various starting positions, in order to roll past the probe 5. The differing starting positions are obtained either by releasing the coin at one and the same point but in rotational positions mutually displaced by identical angles, or respectively in the same position at locations of the roll track mutually displaced along the roll track by respectively a fraction of the coin circumference. Thereby, for each acceptable coin, analog signals are obtained along tracks uniformly distributed over the impress design. By designing the probe 5 correspondingly, the objective is attained that the diameter of the area of its magnetic alternating field wherein its selfinduction and, respectively, damping, can be influenced the strongest, corresponds to a width of the scanning track where tracks running side-by-side essentially adjoin one another. The signal obtained with a coin to be checked is compared with each of the stored signals and, in case of adequate coincidence, a coincidence signal is transmitted.

According to FIG. 5, the probe 5 constitutes the oscillating circuit coil of an oscillator 13. The output voltage of the latter is demodulated in a demodulator 18 whereby, for example, the analog signal 14 shown in FIG. 6 is obtained. A scanner 20 controlled by a clock pulse generator 19 yields signals 21 corresponding to discrete values of the analog signal 14 succeeding one another at intervals of, for example 1 ms. FIG. 6 shows only a few of these signals 21. In this process, for example 50 signals 21 are obtained from signal 14. In the illustrated embodiment (FIGS. 5 and 6), further processing of signals 21 and comparison with the stored signals take place according to the digital method. Accordingly, an analog-to-digital converter 23 follows scanner 20. The digital method is performed under practical conditions by means of a microprocessor, indicated in FIG. 5 by a dot-dash frame 25. In this frame 25, several component groups essential for mode of operation are illustrated in simplified form, merely for reference in the description of the processes set forth below.

The number of signals 21 produced by the coin to be verified depends on the diameter and travel velocity of the coin, and this applies also in case signals, relating to respectively one kind of acceptable coin and to be stored in memory 33, are to be generated for signal comparison.

Since sequences of signals of discrete values are comparable with one another only if each sequence contains the same number of signals, an always identical number Z of signals distributed essentially uniformly over the signal sequence is selected from this signal sequence 21. For this purpose, the signals 21 are transmitted to a first shift register 27 and simultaneously to a counter 28. A divider 29 divides the number Z of signals 21 by the desired number z of signals to be selected. The selection principle then resides in that a selection circuit 31 transmits the first (or last) of respectively n successive signals 21 to a second shift register 32 wherein n equals Z divided by z. However, n is not as a rule an integer. In a simple selection procedure, n is rounded off to the next smaller integer, and the selection circuit 31 is controlled by the rounded-off number. Although thereby the desired number of signals is selected, a final portion of signal sequence 21 is not taken into consideration. In a more perfect selection procedure, the integral multiples of the quotient n are rounded off or, respectively, up to an integer, and those of signals 21 are selected, the position of which in the signal sequence corresponds to the rounded-up or rounded-off numbers. For example, if n equals 3.3, then the integral multiples are 3.3, 6.6, 9.9, 13.2, . . . , and the third, seventh, tenth, thirteenth, . . . of the signals 21 is selected, i.e. transferred from the first shift register 27 into the second shift register 32.

The signal sequence stored in the second shift register 32 is compared in a comparator with each of the signal sequences stored in the memory 33, obtained with the acceptable types of coins, by comparing respectively the first, second, . . . , z-th signal of the signal sequence stored in the second shift register 32 with the first, second, . . . , z-th signal of the signal sequence in memory 33 to be compared, and by forming the difference in a subtracter 34. An adder 36 adds up the absolute values of the differences. A comparator 38 transmits a coincidence signal to a line 39 if the sum total obtained from the adder 36 falls below a predetermined value.

For the purpose of increasing verification accuracy, two probes succeeding each other in the coin travel direction can be arranged at identical distances from the roll track surface 1 (FIGS. 1 and 2); the verification signal from each of the two probes can be compared with the signals stored in the memory; and a coincidence signal can be produced if the comparison yields in case of one of the two verification signals a coincidence within the given limits. In this process, the two verification signals (if the spacing of the probes in the travel direction of the coins is small) can be scanned alternatingly (as in the time-division multiplex method), and the discrete values of one verification signal can be stored in one shift register and those of the other signal in another one of two shift registers taking the place of the shift register 27. Since the velocity of the coin hardly varies at all along the short path between the two probes, it will be sufficient to count the discrete values of one of the two signals, because the two scanned tracks have equal length. Further processing of each of the two signals takes place in correspondence with the signal processing described for one verification signal and is performed in the correspondingly programmed microprocessor.

The effect on the probe depends not only on the distance of the probe from the site on the coin surface located in front of the probe, but also on the property of the coin alloy. For this reason, coins having the same diameter and the same impress design will yield a coincidence signal only if also the alloys coincide within the given limits. Since—as mentioned—coins having differing diameters, exhibiting the same impress design in correspondingly differing sizes, are likewise distinguished from one another by the aforedescribed checking procedure, this checking procedure alone is basically sufficient for making a distinction between acceptable coins and unacceptable coins.

On account of the expenditure incurred in checking the impress design, the latter is preferably suitable in connection with coins of higher denominations. Accordingly, it may be advantageous to provide the present device in a coin checker wherein, as usual, for example diameter, thickness and alloy characteristic of the coins are checked, and to activate the verification of the impress design only in case these usual checking operations reveal that an acceptable coin of a higher denomination may be involved. In this connection, signal processing can take place in all verification operations with one and the same microprocessor. If verification of the impress design is utilized only in case of coins of higher denominations, then a smaller capacity of memory 33 is adequate, or, which is more important under certain circumstances, with a given memory capacity, a greater number of discrete values of a larger number of tracks can be stored for each of the few coins of higher denominations, thus obtaining a larger resolution capacity during the design scanning.

We claim:

1. A device for coin verification, comprising a coin guide (1, 3) with a roll track surface (1) for the coin (2) to be checked and a lateral, steep guide surface (3) along which the coin (2) rolling on the roll track surface (1)

slides in contact therewith; at least one inductive probe (5) excited by high frequency and arranged at the guide surface, for scanning on a track (10, 11) on that side of a coin (2) passing along the coin guide (1, 3) which slidingly contacts the guide surface (3) and thereby obtaining a signal (14) constituting information on the portion of the impress design extending along the track (10, 11); a scanner (20) and an analog-to-digital converter (23) connected in circuit with said at least one inductive probe (5), for the derivation of a sequence of digital signals corresponding to discrete values (21) of the signal (14) obtained from the coin to be checked, which discrete values follow one another at identical time intervals; evaluating means (25) including a memory (33) for storing the sequence of digital signals obtained for each track (10, 11) from various starting positions for each coin type acceptable while sliding with one and while sliding with the other coin side along the guide surface (3); and comparison means (34, 36, 38) connected with said analog-to-digital converter (23) and said memory (33) for comparing the signal sequence obtained from the coin (2) to be checked, with each of the stored signal sequences in the memory (33) and yielding a coin design coincidence signal if the signal sequence obtained from the coin to be checked corresponds within certain limits to one of the stored signal sequences.

2. A device according to claim 1, in which said comparison means (34, 36, 38) includes a first comparison circuit (34) operative to compare each of the digital signals of the signal sequence obtained from the coin (2) to be checked with the corresponding signal of each of the stored digital signal sequences, and transmitting upon each comparison a comparison signal indicating the extent of deviation of the compared signals; and adder (36) connected to said first comparison circuit (34) which adds up the comparison signals obtained by comparison with respectively one of the stored signal sequences; and a second comparison circuit (38) connected to said adder (36) and operative to transmit the coin design coincidence signal if the sum total is within specific limits.

3. A device according to claim 2, in which said first comparison circuit comprises a subtracter (34) for the signals to be compared, this subtracter yielding a comparison signal which indicates the absolute value of the difference.

4. A device according to claim 2, in which the first comparison circuit (34) comprises a subtracter for the signals to be compared and a multiplier for squaring the differences, and is operative to transmit the square of the difference as the comparison signal.

5. A device according to claim 2, in which said evaluating means (25) includes a selection circuit (28, 29, 31) which is operative to select from the signal sequence obtained by scanning and digitalizing a predetermined number of signals essentially uniformly distributed over this signal sequence, for signal comparison.

6. A device according to claim 5, in which the selection circuit contains a counter (28) for counting the signals obtained by the scanning from said at least one inductive probe (5), and contains a divider (28) for dividing the number of signals counted by said counter (28) by the predetermined signal number, in order to select respectively the first of n successive signals, wherein n is the quotient obtained by the division.

* * * * *